US008636570B2

(12) United States Patent
Tastad

(10) Patent No.: US 8,636,570 B2
(45) Date of Patent: Jan. 28, 2014

(54) ELECTRICAL CONNECTION IN A SPLIT POST OF A WAGERING GAME CHAIR

(75) Inventor: Gregory J. Tastad, Kenosha, WI (US)

(73) Assignee: WMS Gaming Inc., Waukegan, IL (US)

( * ) Notice: Subject to any disclaimer, the term of this patent is extended or adjusted under 35 U.S.C. 154(b) by 706 days.

(21) Appl. No.: 12/496,300

(22) Filed: Jul. 1, 2009

(65) Prior Publication Data

US 2011/0003631 A1 Jan. 6, 2011

(51) Int. Cl.
*A63F 9/24* (2006.01)
*A47C 31/00* (2006.01)

(52) U.S. Cl.
USPC ..... 463/1; 463/47; 297/217.1; 297/217.3

(58) Field of Classification Search
USPC ..... 463/1, 35, 47; 297/217.1, 217.3, 172, 297/174
See application file for complete search history.

(56) References Cited

U.S. PATENT DOCUMENTS

| | | | | |
|---|---|---|---|---|
| 3,542,326 | A | 11/1970 | Reapsummer | |
| 4,560,200 | A | 12/1985 | Giannelli et al. | |
| 5,409,296 | A | 4/1995 | Barile | |
| 5,678,886 | A | 10/1997 | Infanti | |
| 5,791,731 | A * | 8/1998 | Infanti | 297/217.3 |
| 6,227,614 | B1 * | 5/2001 | Rubin | 297/172 |
| D559,328 | S | 1/2008 | Rasmussen et al. | |
| 7,367,886 | B2 | 5/2008 | Loose et al. | |
| 7,407,228 | B1 | 8/2008 | Infanti | |
| 7,479,063 | B2 | 1/2009 | Pryzby et al. | |
| 2005/0282631 | A1 | 12/2005 | Bonney et al. | |
| 2007/0270216 | A1 | 11/2007 | Pryzby | |
| 2008/0039215 | A1 | 2/2008 | Hahn | |
| 2008/0054561 | A1 | 3/2008 | Canterbury et al. | |
| 2008/0211276 | A1 | 9/2008 | Rasmussen | |
| 2008/0246321 | A1 | 10/2008 | Canterbury | |

* cited by examiner

*Primary Examiner* — David L Lewis
*Assistant Examiner* — Robert Mosser
(74) *Attorney, Agent, or Firm* — Schwegman, Lundberg & Woessner, P.A.

(57) ABSTRACT

In some example embodiments, an apparatus that includes a wagering game chair for a wagering game machine that is configured to present a wagering game. The wagering game chair includes a seat having a seat bottom and a seat post that is part of a split-post configuration. The seat post has a top end and a bottom end, wherein the top end of the seat post is coupled to the seat bottom. The wagering game chair also includes a first electrical connector positioned within and approximately at the bottom end of the seat post. The wagering game chair includes a first electrical cable is electrically coupled to the first electrical connector, wherein the first electrical cable runs approximately a length of the seat post within the seat post. The first electrical cable configured to communicate audio of the wagering game, from the wagering game machine to a speaker coupled to the wagering game chair.

17 Claims, 11 Drawing Sheets

ELECTRICAL CONNECTION IN A SPLIT POST OF A WAGERING GAME CHAIR

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

BACKGROUND

Game machines including wagering game machines such as slot machines, video poker machines and the like, have been a part of the gaming industry for several years. A number of game machines now include game chairs (used by the game player) incorporated as part of the game machines. In particular, these game machines can be electrically coupled to the game chairs to enhance the player experience. For example, speakers can be incorporated into the game chairs to enable surround sound as part of the game play.

BRIEF DESCRIPTION OF THE FIGURES

Embodiments of the invention are illustrated by way of example and not limitation in the Figures of the accompanying drawings in which.

DESCRIPTION OF THE EMBODIMENTS

Figure 1:
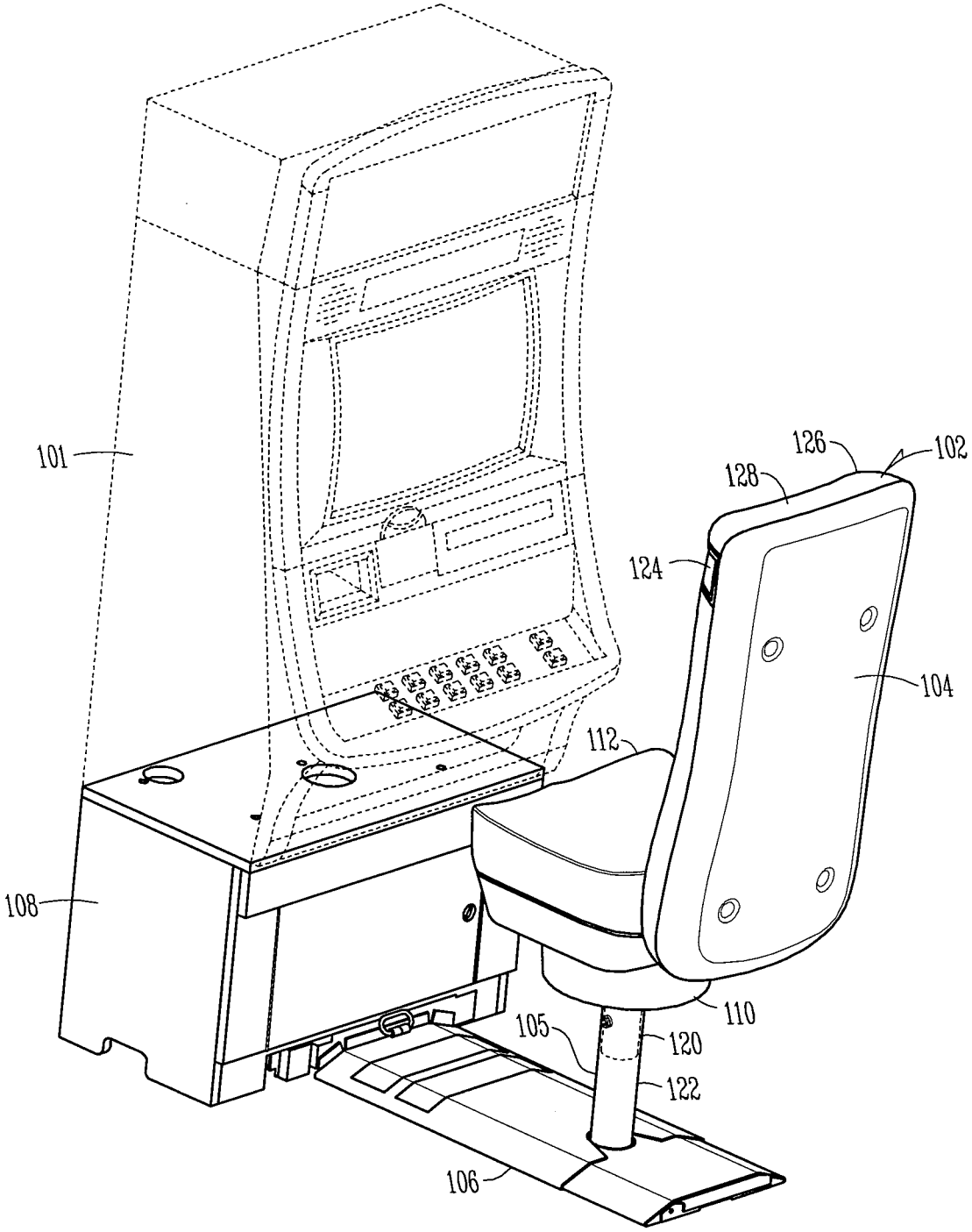
FIG. 1 is a wagering game chair for coupling to a wagering game machine through a sled assembly, according to some example embodiments.

This description is divided into six sections. The first section includes an introduction to some example embodiments. The second section describes some example embodiments of a split-post for electrically connecting a wagering game chair to a wagering game machine through a sled assembly. The third section describes some example embodiments of the sled assembly. The fourth section presents some example operations. The fifth section describes an example wagering game machine, and the sixth section provides some general comments.

Introduction

In some example embodiments, methods, apparatus and systems include a split post configuration to provide an electrical connection between a wagering game machine and a wagering game chair through a sled assembly. While described relative to a wagering game machine, some example embodiments may be executed in any type of game machine (e.g., video or mechanical slot machine, video poker machine, pachinko game devices, Amusement With Prize machines, etc.).

Current configurations for electrically connecting a wagering game machine to a wagering game chair are generally considered labor intensive. These configurations have required disassembly and reassembly of various parts so that the electrical connection can be made. For example, these configurations require disassembly of the bottom end of the chair. In particular, a cover underneath the chair bottom housed the electrical connection within the wagering game chair. If the chair included a foot rest below the chair bottom, the bolts for the foot rest were first loosened, allowing the foot rest to drop down. Bolts holding the cover in position were then loosened, allowing the cover to drop down. The electrical cable coming from the wagering game machine through a sled assembly could then be connected to an electrical connector within the wagering game chair. The cover could then be repositioned and bolted in place. Similarly, the foot rest could also be repositioned and bolted back in place.

Some example embodiments include a split post configuration to enable a much easier assembly (relative to current configurations). The split post configuration comprises two different posts that are engaged one post inside the other post. A first post comprises a seat post that is connected below the wagering game chair. A second post comprises a sled post that is above and part of the sled assembly that is used to connect the wagering game machine to the wagering game chair. Accordingly, some example embodiments allow the wagering game chair to be self-contained during the electrical connection between the wagering game machine and the wagering game chair. In particular, the wagering game chair is not required to be disassembled in order to electrically connect the wagering game machine to the wagering game chair. With regard to the figures now described, a same reference number is used across the figures for a same component (e.g., a reference number 120 is used to reference a seat post across multiple figures).

Split-Post for Electrical Connection

Figure 10:
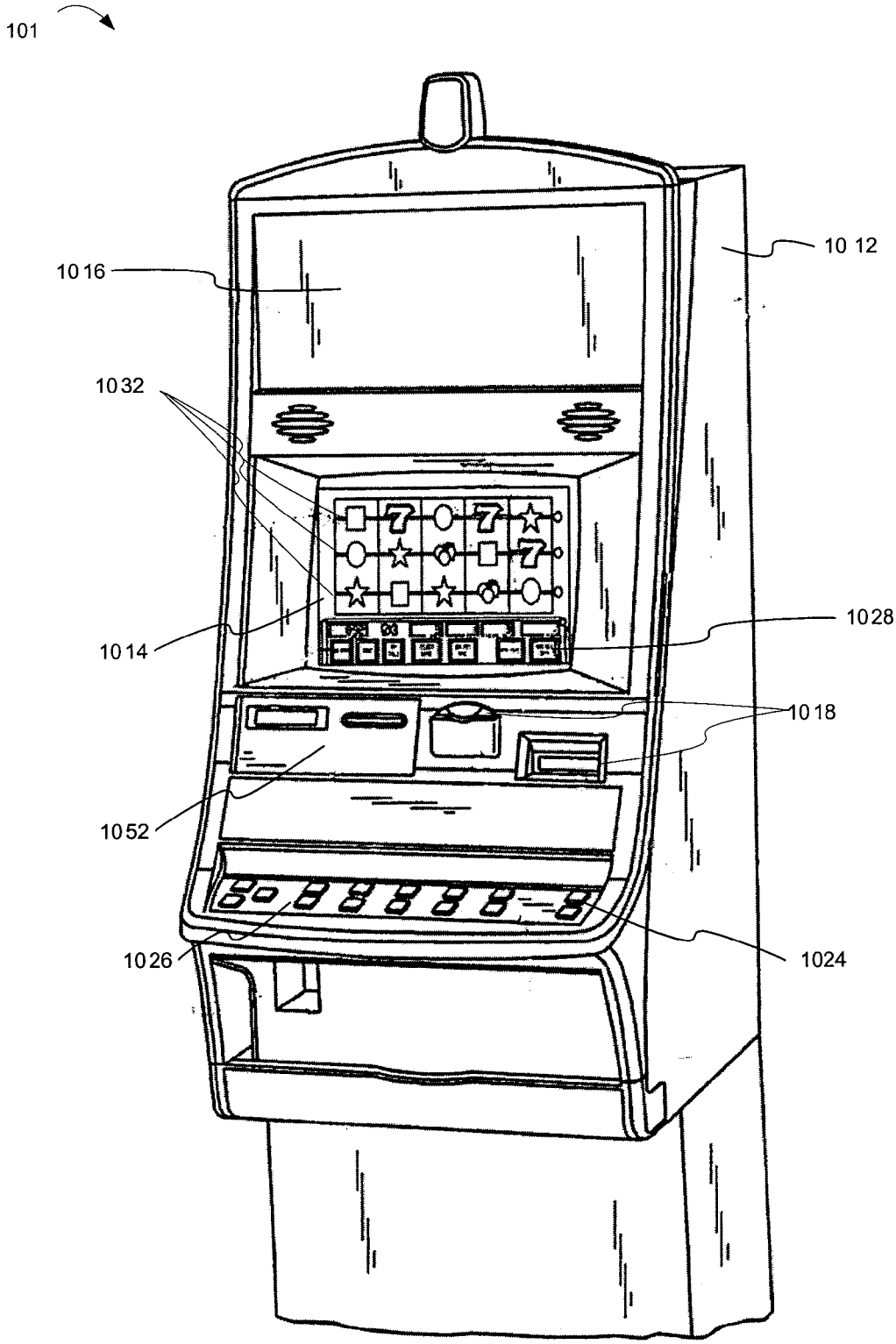
FIG. 10 is a perspective view of a wagering game machine, according to some example embodiments.

Some example embodiments that include a split-post for electrically connecting a wagering game chair to a wagering game machine through a sled assembly are now described. FIG. 1 is a wagering game chair for coupling to a wagering game machine through a sled assembly, according to some example embodiments. FIG. 1 includes a wagering game chair 102, a sled assembly 106 and a wagering game machine stand 108. A wagering game machine 101 is positioned on top of the wagering game machine stand 108. Some example embodiments of such a wagering game machine is shown in FIG. 10 (described in more detail below). The wagering game chair 102 comprises a seat back 104, a seat bottom 112 and a bottom cover 110 under the seat bottom 112. In some example embodiments, the bottom cover 110 houses a swivel (not shown) to enable the wagering game chair 102 to rotate around an axis along a split post 105. The wagering game chair 102 also includes a seat post 120 that extends down from the bottom cover 110. The seat post 120 is one of two posts that is part of the split post 105. The sled assembly 106 includes a sled post 122 that extends up from a base of the sled assembly 106. The sled post 122 is the second of the two posts that is part of the split post 105.

The seat back 104 includes different audio components. In this example, the audio components include a speaker 124, a speaker 126 and a subwoofer 128 to enable a surround sound experience for the game player during operation of the wagering game machine 101. Other audio configuration and/or components are possible. For example, in a different configuration, a single speaker is used. In another configuration, two speakers are used (without a subwoofer). In another configuration, additional speakers and/or subwoofers are included.

Electrical cables (not shown) run from the bottom cover 110 to the speakers 124 and 126 and the subwoofer 128. Such electrical cables can be used for power and/or audio signaling between the wagering game machine 101 and the speakers 124-126 and the subwoofer 128.

These electrical cables also run down through the seat post 120 and are connected to a bracket at the bottom of the seat post 120. In some example embodiments, the controller driving the speakers 124-126 and the subwoofer 128 is within the wagering game stand 108 or the wagering game machine 101. The seat post 120 and the sled post 122 are hollow and used for housing electrical cables (as further described below). In some example embodiments, the seat post 120 and the sled post 122 are comprised of steel, aluminum, titanium, etc. or a combination thereof.

Example embodiments are described such that the sled assembly is coupled to the wagering game machine through a wagering game stand. However, in other embodiments, the sled assembly can be directly connected to the wagering game machine (without the wagering game stand). While described such that the electrical cables are used for signaling and/or powering for audio components, example embodiments can be used for signaling or powering of any type of electrical component (e.g., lights, cameras, video, etc.).

Figure 2:
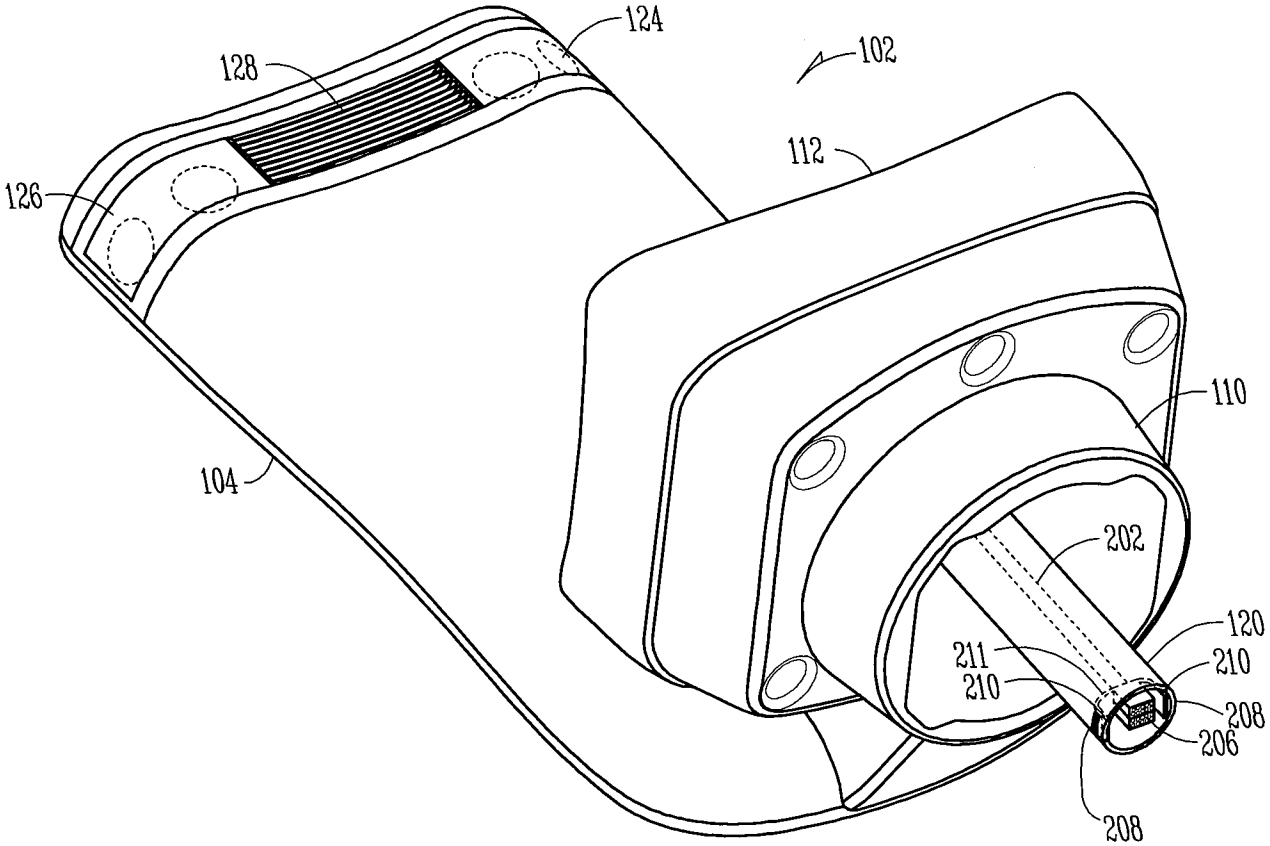
FIG. 2 is a more detailed diagram of the wagering game chair, according to some example embodiments.

FIG. 2 is a more detailed diagram of the wagering game chair, according to some example embodiments. FIG. 2 shows the wagering game chair 102 having the seat back 104, the seat bottom 112 and the bottom cover 110. The seat back 104 includes the speakers 124-126 and the subwoofer 128. The seat post 120 extends down from the seat bottom 112. Electrical cables 202 run within the bottom cover 110 (through an opening 220 in the bottom cover 110) and up to the speakers 124-126 and subwoofer 128 through the seat back 104. The electrical cables 202 also run down through the seat post 120. The electrical cables 202 run to the bottom of the seat post 120 and is coupled to an electrical connector 206.

In some example embodiments, the electrical cables 202 are flex cables Using flex cables enable the wagering game chair 102 to rotate using the swivel (as described above). In some example embodiments, the wagering game chair 102 can rotate approximately 90 degrees to the right and to the left of a center position facing the waging game machine 101.

In some example embodiments, the electrical connector 206 is mounted such that the electrical connector 206 is beyond the end of the seat post 120. The seat post 120 can include recesses 208. A bracket 211 includes retainer clips 210. The electrical connector 206 is coupled into the bracket 211. The retainer clips 210 can be placed into the recesses 208 so that the electrical connector 206 is affixed to the end of the seat post 120 (locked in a position in the seat post 120).

Figure 3:
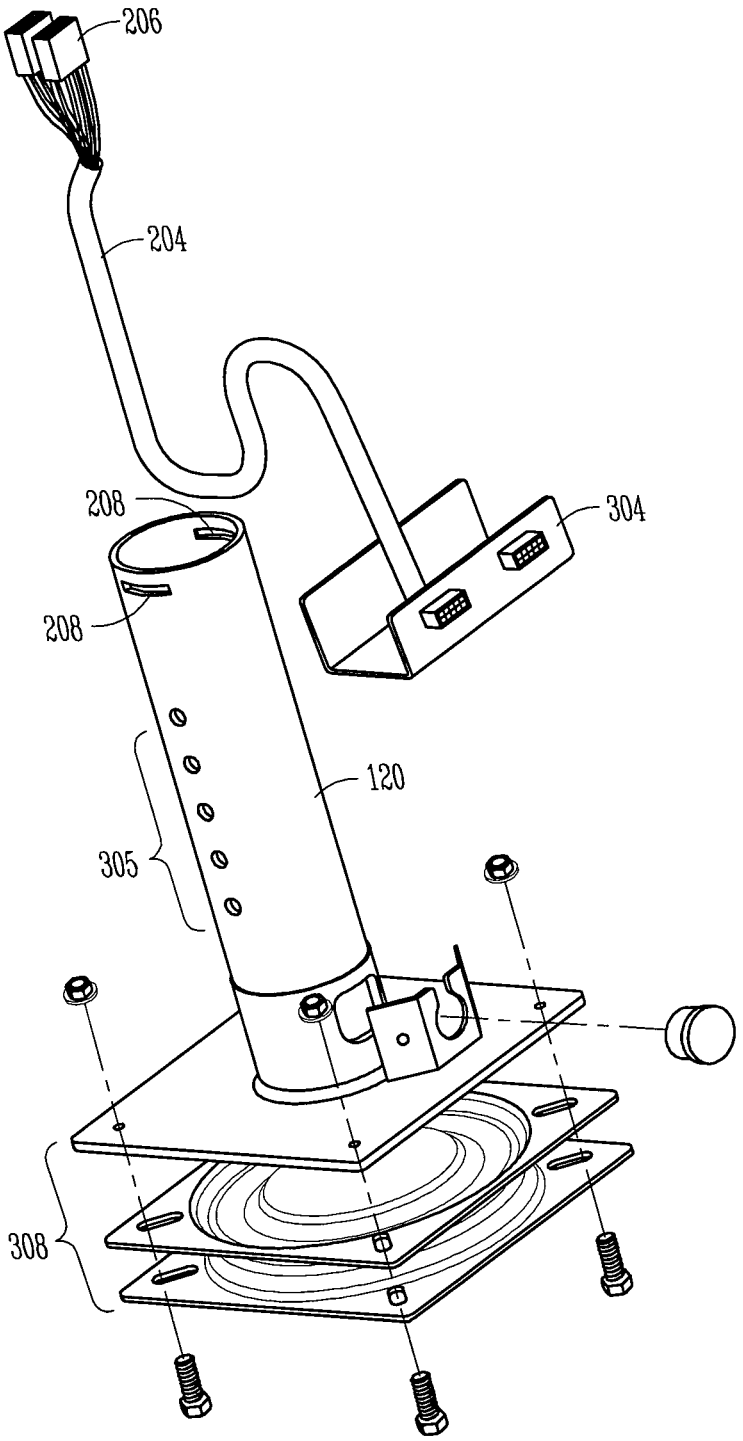
FIG. 3 is a more detailed diagram of the seat post and the associated electrical cable, according to some example embodiments.

To better illustrate, FIG. 3 is a more detailed diagram of the seat post and the associated electrical cable, according to some example embodiments. As described above, the seat post 120 includes the recesses 208. The electrical cable 202 coupled to the electrical connector 206 is shown outside the seat post 120 to better illustrate. The seat post 120 is coupled to a base 308 that is part of the seat bottom 112. Also shown in FIG. 3, an electrical connector 304 is coupled to an opposite end of the electrical cable 202 relative to the end where the electrical connector 206 is located. A different electrical cable (not shown) can be coupled to the electrical connector 304. This different electrical cable can run up the seat back 104 to the speakers 124/126 and the subwoofer 128.

The seat post 120 also includes holes 305 at a number of different heights. Some type of component (such as a bolt (not shown)) can be run through a set of the holes 305 at a given height to allow the wagering game chair 102 to be positioned at different heights. In some example embodiments, a set of holes 305 are spaced apart at one inch increments. In some example embodiments, the holes 305 enable height adjustment of the wagering game chair 102 from 20-24 inches.

Figure 4:
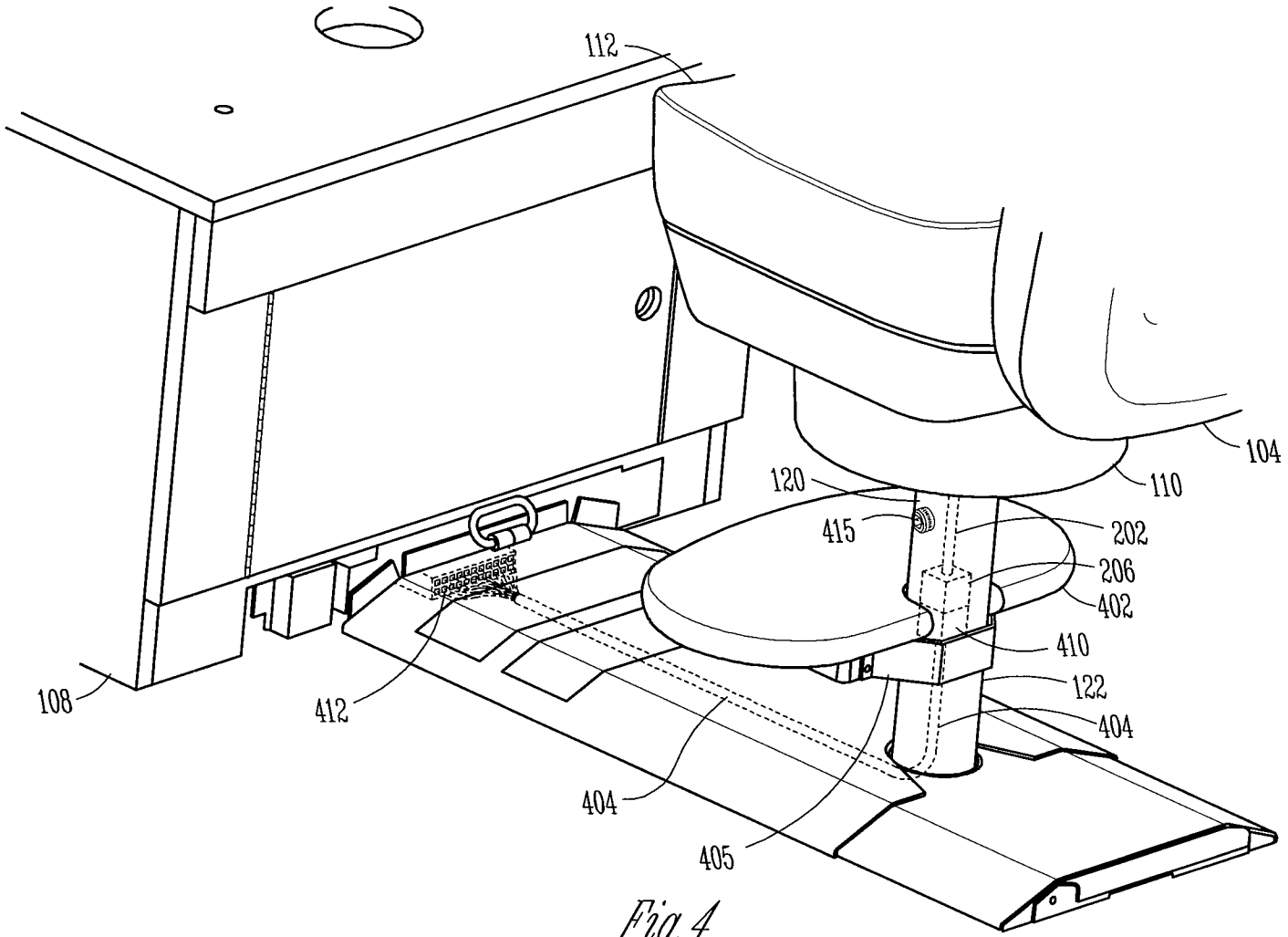
FIG. 4 is a more detailed diagram of parts of the sled assembly including the sled post, according to some example embodiments.

A more detailed discussion of the sled post is now described. FIG. 4 is a more detailed diagram of parts of the sled assembly including the sled post, according to some example embodiments. The sled assembly 106 includes the sled post 122. An electrical cable 404 is housed in the base of the sled assembly 106 and up into the sled post 122. As shown, the electrical cable 404 runs from an end of the sled assembly 106 that is coupled to the wagering game stand 108 in the base of the sled assembly 106 and up into the sled post 122. An electrical connector 412 is coupled to an end of the electrical cable 404 for electrically coupling with a wagering game interface of the wagering game stand 108. An electrical connector 410 is coupled to the other end of the electrical cable 404 for electrically coupling to the electrical connector 206. In some example embodiments, the electrical connector 410 is not affixed to the sled post 122. For example, the electrical connector 410 is not locked into a position using retainers (similar to the electrical connector 206). Rather, the electrical cable 404 is free from a locked position.

In some example embodiments, a length of the electrical cable 404 runs from the wagering game stand 108 and beyond a top end of the sled post 122. The extension beyond the top end of the sled post 122 allows the electrical connector 410 to be more easily connected to the electrical connector 206. Also, the extension beyond the top end of the sled post 122 allows for horizontal and vertical adjustments of the wagering game chair 102. In particular, the electrical connector 410 can be connected to the electrical connector 206 prior to putting the seat post 120 and the sled post 122 into the split post configuration. As described above, the height of the wagering game chair 102 can be adjusted in a range of four inches (20-24 inches). As further described below, the sled assembly 106 can be adjusted to allow the wagering game chair 102 to be different distances from the wagering game machine 101. In some example embodiments, the range of this adjustment between the wagering game chair 102 and the wagering game stand 108 is six inches. Therefore, a length of the electrical cable 404 can include the distance from the wagering game stand 108 to the top end of the sled post 122 and additional 10 inches to allow for maximum adjustment (six inches of horizontal adjustment (outward from the wagering game machine 101) and four inches of vertical adjustment (upward from the floor)). In some example embodiments, the electrical cable 404 can be within a nylon mesh sleeve to protect the wiring.

After the seat post 120 and the sled post 122 are combined to form the split post 105, a component 415 is positioned in one of the set of holes 305 (depending on the height adjustment of the wagering game chair 102). In some example embodiments, the component 415 is a hex drive cap screw. In some example embodiments, the hex drive cap screw can be threaded into a threaded bushing after placement through the set of the holes 305. The component 415 can any be other type of component placed through a set of the holes 305 to hold the wagering game chair 102 at a given height (e.g., a pull pin, screw/bolt combination, etc.). As shown, a foot rest 402 can also be included underneath the wagering game chair 102. The foot rest 402 can be positioned underneath the wagering game chair 102, wherein a clamp 405 wrapped around the split post 105 can hold the foot rest 402 at a given height.

While described such that the electrical cable 202 is locked in a fixed position in the seat post 120 through the retainer clips 210 and the electrical cable 404 is not locked in a fixed position, some example embodiments are not so limited. In other example embodiments, the electrical cable 202 is not fixed, while the electrical cable 404 is in a fixed position (using a similar retainer configuration). In other example embodiments, both the electrical cable 202 and the electrical cable 404 are not locked in a fixed position. In other example embodiments, both the electrical cable 202 and the electrical cable 404 are locked in a fixed position (using a similar retainer configuration). In such embodiments, the connection between the electrical connector 206 and the electrical connector 410 is a blind mate connection.

Sled Assembly

Figure 5:
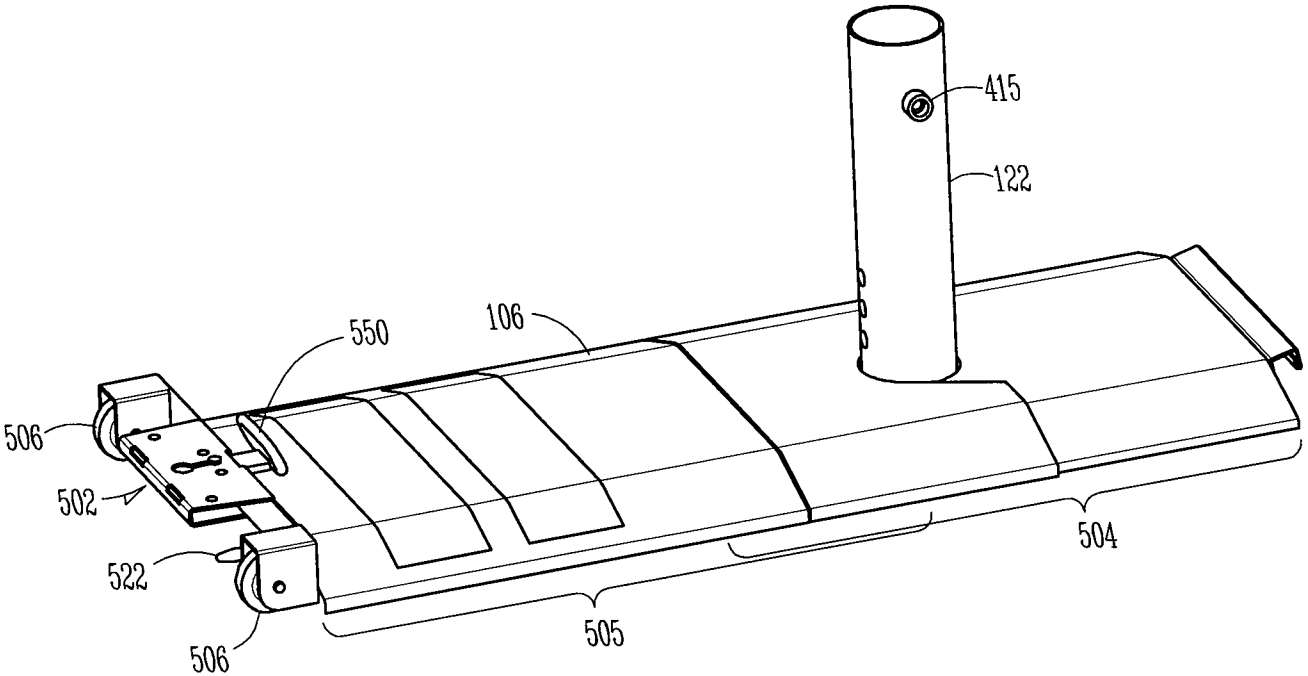
FIG. 5 is a perspective view of the top side of the sled assembly, according to some example embodiments.
Figure 6A:
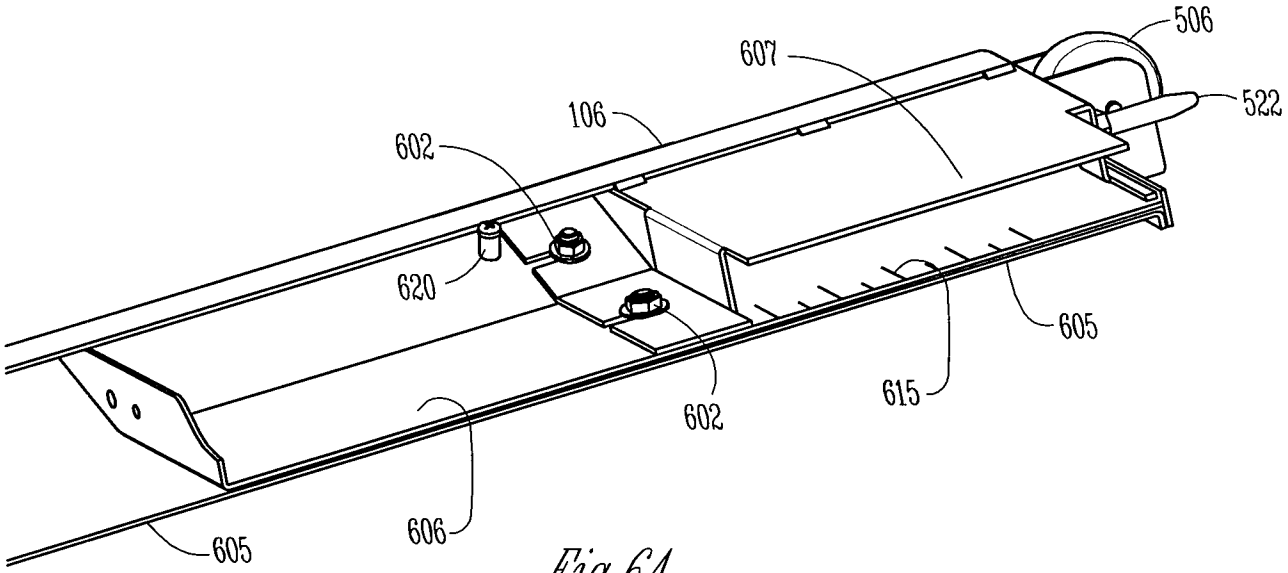
FIGS. 6A-6B are perspective views of the bottom side of the sled assembly, according to some example embodiments.
Figure 6B:
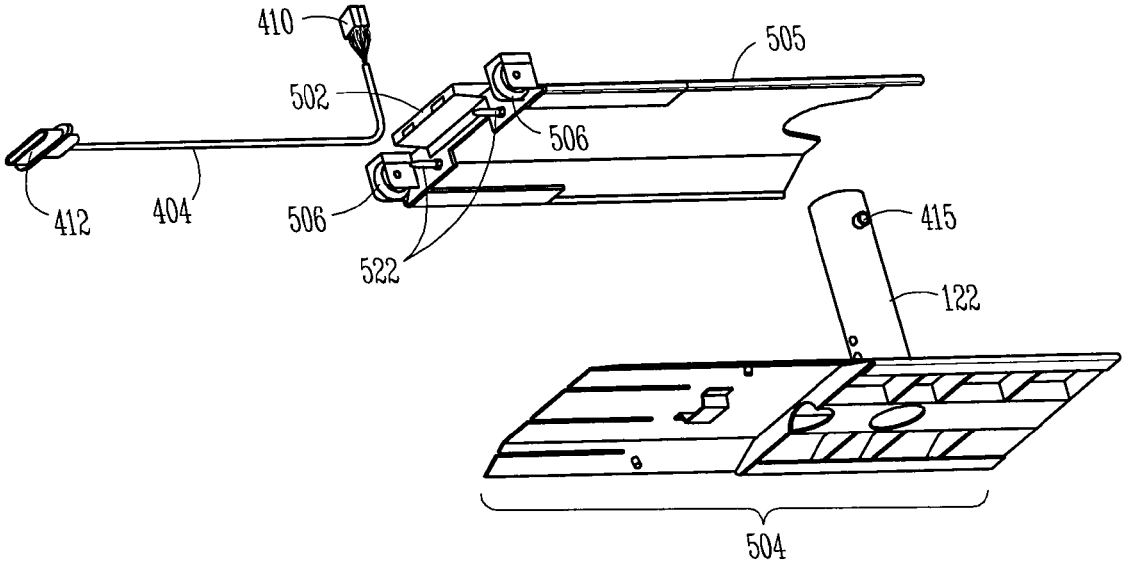

A more detailed description of the sled assembly 106 is now described. FIG. 5 is a perspective view of the top side of the sled assembly, according to some example embodiments. FIGS. 6A-6B are perspective views of the bottom side of the sled assembly, according to some example embodiments. FIG. 5 and FIGS. 6A-6B are described together.

The sled assembly 106 includes a latching portion 505 that includes a game interface 502 for plugging into a mating connector of the wagering game stand 108. The sled assembly 106 also includes a sled post portion 504 that includes the sled post 122. As shown, the latching portion 505 overlaps with the sled post portion 504.

The latching portion 505 comprises an outer panel 605 and an under panel 607. The outer panel 605 and the under panel 607 are a first formed metal and a second formed metal, respectively. The sled post portion 504 comprises a panel 606 that is a third formed metal. As shown, the panel 605 runs over the top of the panel 606.

The sled assembly 106 is also adjustable to enable the adjusting of the distance from the wagering game machine stand 108 and the wagering game chair 102. The sled assembly 106 includes nuts 602 to allow for this adjustment. The under panel 607 includes gauge markers 615 for tracking the distance of the adjustment of the sled assembly 106. While the gauge markers 615 have set marks, the marks are only for tracking the distance. The adjustment can be made at any point along the continuum of the distance of adjustment noted by the gauge markers 615. To adjust, the nuts 602 are loosened. The panel 606 is then adjusted relative to the outer panel 605 and the under panel 607. The nuts 602 can then be retightened. The sled assembly 106 also includes an adjustment limiter screw 620. The adjustment limiter screw 620 limits the adjustment to the maximum distance. Accordingly, the adjustment limiter screw 620 prevents that the latching portion 505 from being totally disengaged from the sled post portion 504. Therefore, an adjuster does not accidentally disengage the two portions during the adjusting process. The sled assembly 106 also includes a release handle 550 (further described below).

Figure 7:
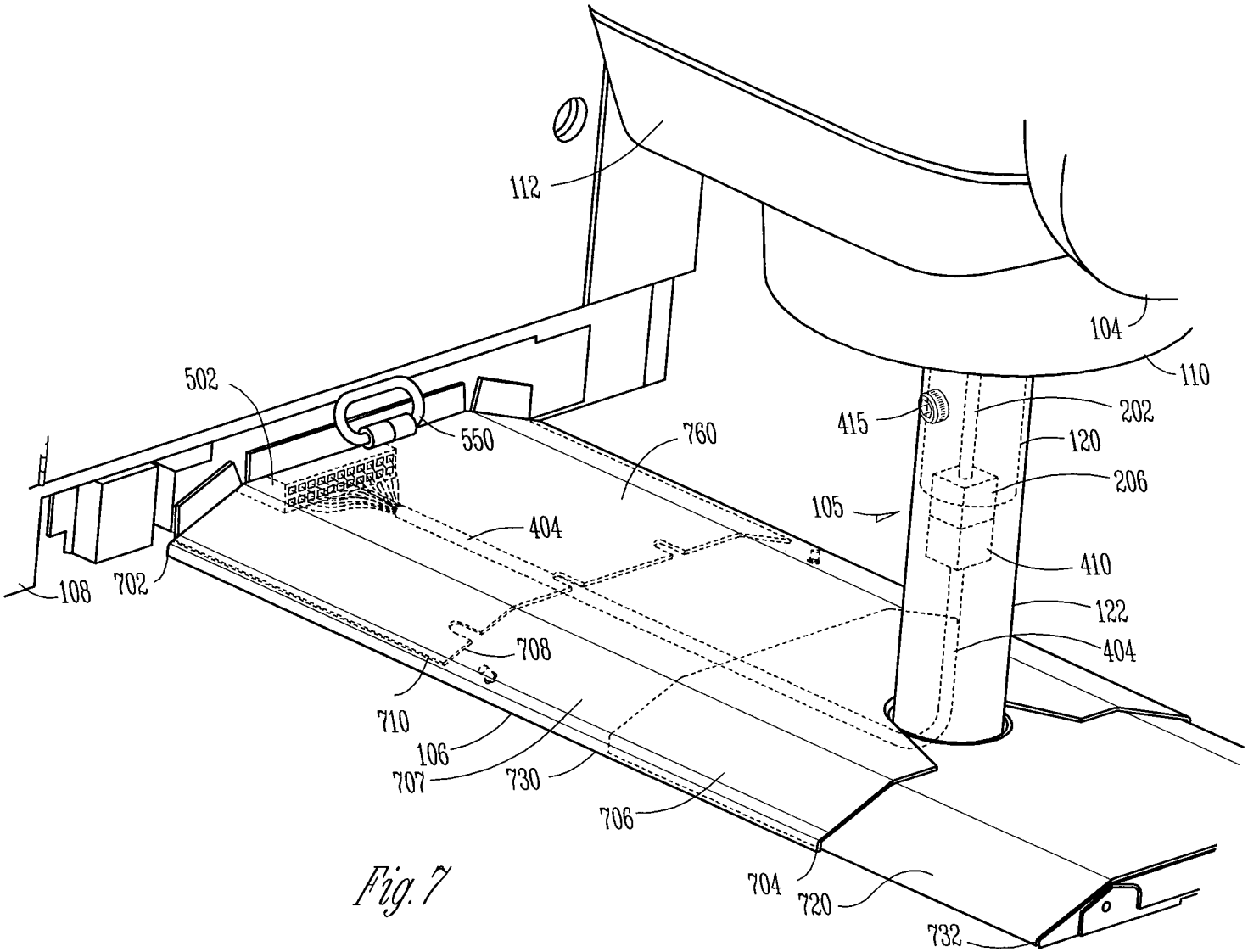
FIG. 7 is a perspective view of the sled assembly providing a more detailed diagram of the different layers or panels thereof, according to some example embodiments.

To further illustrate, FIG. 7 is a perspective view of the sled assembly providing a more detailed diagram of the different layers or panels thereof, according to some example embodiments. FIG. 7 includes a number of points along the sled assembly 106 to assist in identifying the different panels. The different panels can be different formed metals that are layered. Some of the different panels can be welded together (further described below). From left to right in the diagram, FIG. 7 includes a point 702, a point 710, a point 730, a point 704 and a point 732. Such points identify the ends of the different panels.

The latching portion 505 of the sled assembly 106 comprises two different panels that can be welded together. The latching portion 505 includes a lower panel 760 that runs from the point 702 to the point 710. The latching portion 505 also includes an upper panel 706 that is positioned on top of the lower panel 760. The upper panel 706 runs from the point 702 to the point 704.

The sled post portion 504 of the sled assembly 106 comprises two different panels that can be bolted together. The sled post portion 504 includes a lower panel 720 that runs from the point 730 to the point 732. The sled post portion 504 also includes an upper panel 707 that runs the point 704 to the point 702. The section of the upper panel 707 from the point 710 to the point 730 comprises the adjustment part of the sled post portion 504 (as described above). The upper panel 707 of the sled post portion 504 is encapsulated by the lower panel 760 and the upper panel 706 of the latching portion 505.

Figure 8:
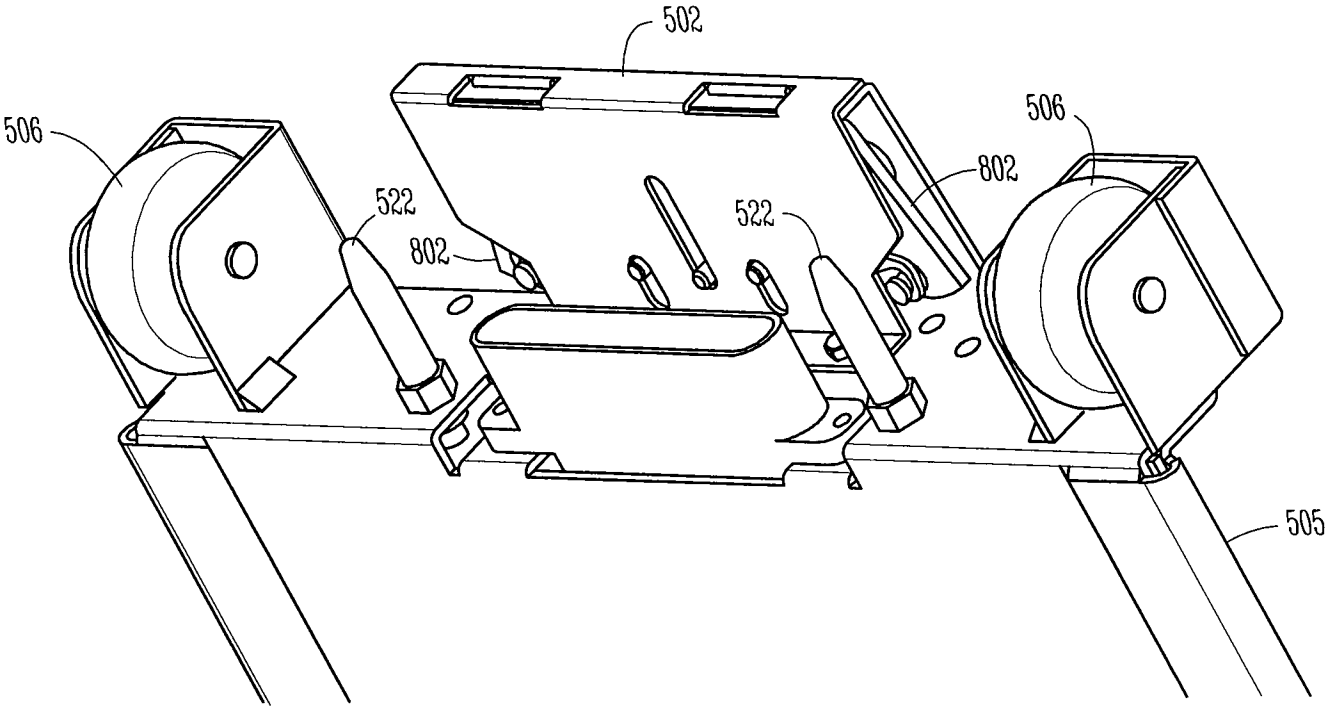
FIG. 8 is a more detailed diagram of the front end of the latching portion of the sled assembly, according to some example embodiments.

FIG. 8 is a more detailed diagram of the front end of the latching portion of the sled assembly, according to some example embodiments. The latching portion 505 includes wheels 506 at an outer part of the end that includes the game interface 502 to allow for easy mobility of the sled assembly 106. In particular, a person can more easily engage and disengage the game interface 502 to the wagering game stand 108 using the wheels 506. The latching portion 505 also includes pins 522 on opposite sides of the game interface 502. The pins 522 are used to guide the connection of the game interface 502 to the wagering game stand 108. In particular, the pins 522 are placed into holes (not shown) of the wagering game stand 108 during the connection.

In some example embodiments, the mating connector of the wagering game stand 108 is a floating connector. Accordingly, the sled assembly 106 can be at different angles (e.g., angled upward) during the connection process. The game interface 502 includes cams 802 on a left and right side of the game interface. The cams 802 are spring loaded so that when the cams 802 are pushed in for connection to the mating connector of the wagering game stand 108 the cams 802 retract. The cams 802 then push out after the connection is complete to secure the connection. The release handle 550 can be pulled to release the cams 802 to allow the game interface 502 to disengage from the mating connector of the wagering game stand 108.

Example Operations

Figure 9:
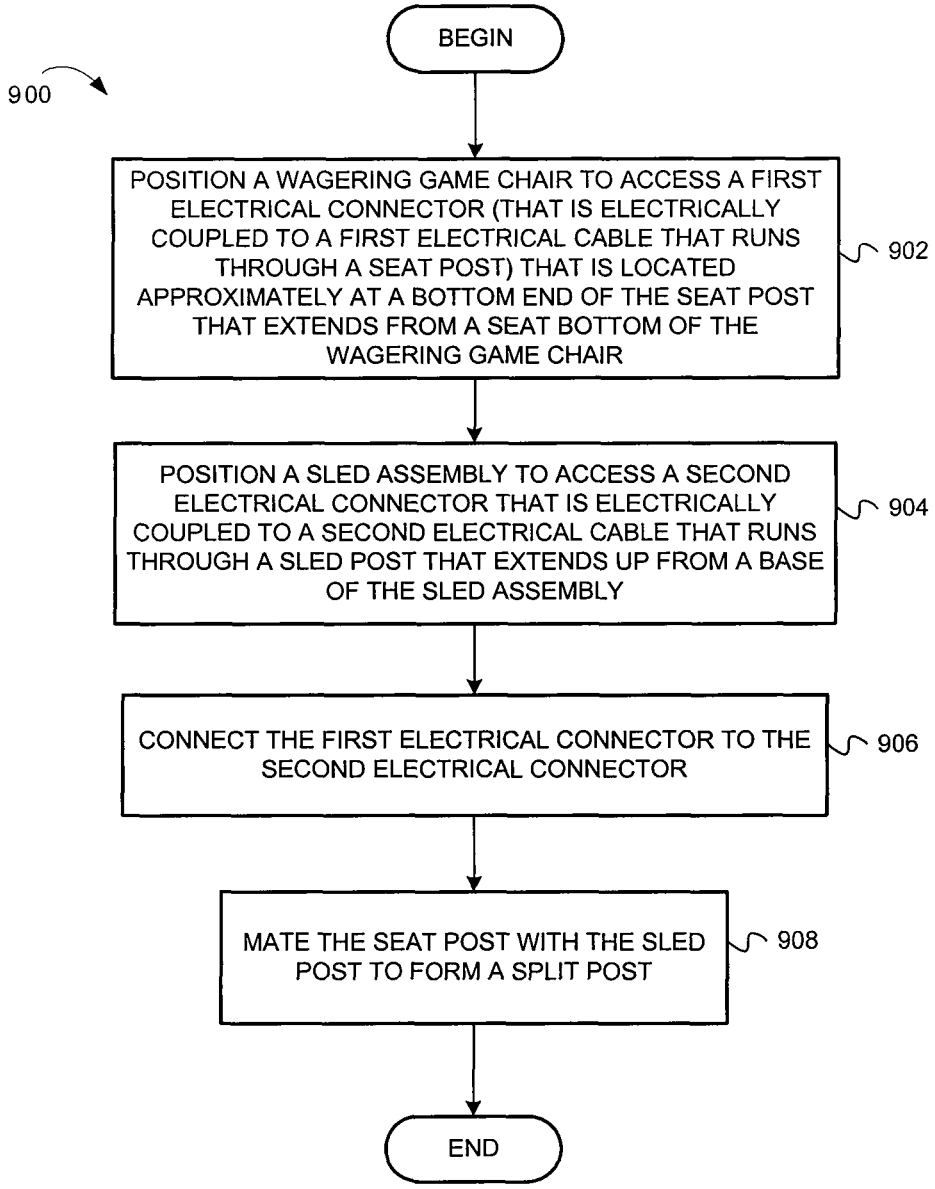
FIG. 9 is a method illustrating operations for electrically coupling a wagering game chair to a sled assembly through a split-post configuration, according to some example embodiments.

This section describes operations performed by some example embodiments. FIG. 9 is a method illustrating operations for electrically coupling a wagering game chair to a sled assembly through a split-post configuration, according to some example embodiments. A method 900 can be performed by one or more persons, machine or a combination thereof. In some example embodiments, the operations are performed as part of the manufacturing/assembly operation (prior to delivery of the wagering game machine to a wagering game site (e.g., casino)). Alternatively or in addition, the operations are performed at the wagering game site during initial installation of the wagering game machine or any time thereafter. A method 900 begins at block 902 and is described with reference to FIGS. 1-8 (described above).

At block 902, the wagering game chair 102 is positioned to enable access to the first electrical connector 206 (that is electrically coupled to the first electrical cable 202 that runs through the seat post 120) that is located approximately at a bottom end of the seat post 120 that extends down from the seat bottom 112 of the wagering game chair 102. For example, the wagering game chair 102 can be set on one of its sides, upside down, etc. The method 900 continues at block 904.

At block 904, the sled assembly 106 is positioned to access the second electrical connector 410 that is electrically coupled to the second electrical cable 404 that runs through the sled post 122 that extends up from a base of the sled assembly 106. For example, the sled assembly 106 can be positioned upright or on one of its sides. The method 900 continues at block 906.

At block 906, the first electrical connector 206 is connected to the second electrical connector 410. In some example embodiments, the first electrical connector 206 is affixed to the seat post 120, while the second electrical connector 410 is not affixed to the sled post 122. As described above, the second electrical connector 410 can be extended beyond the end of the sled post 122 (because of the extra length of the second electrical cable 404). Such a configuration can allow the connection to be more easily made with the wagering game chair 102 and the sled assembly 106 being in a number different positions. As described above, the affixing of the first electrical connector 206 and the second electrical connector 410 to the seat post 120 and the sled post 122, respectively, can vary. For example, both the first electrical connector 206 and the second electrical connector 410 can be affixed to their respective posts. Accordingly, the first electrical connector 206 is blind mated with the second electrical connector 410. In another example, neither the first electrical connector 206 nor the second electrical connector 410 are affixed. Accordingly, either or both connectors can be extended beyond their respective posts to make the connection. Alternatively, the second electrical connector 410 is affixed to the sled post 122, while the first electrical connector 206 is not affixed to the seat post 120. Thus, the first electrical connector 206 can be extended beyond the end of the seat post 120 to make the connection with the second electrical connector 410. The method continues at block 908.

At block 908, the seat post 120 is mated to the sled post 122 to form the split post 105. In some example embodiments, the seat post 120 is placed over the sled post 122 so that the sled post 122 is within the seat post 120. Alternatively, the seat post 120 can be housed in the sled post 122 to form the split post 105. In some example embodiments, the component 415 (such as a bolt) is placed through a set of holes (first and second holes) in the seat post 120 and the sled post 122 to set a height of the wagering game chair 102. In some example embodiments, there are multiple sets of holes (see the holes 305 in FIG. 3) to allow for height adjustment. Additional operations can comprise connecting the sled assembly 106 to the wagering game machine 108. These operations can be before or after the electrical coupling of the wagering game chair 102 to the sled assembly 106 through split post 105. As described above, the sled assembly 106 comprises wheels 506 so that the sled assembly 106 can be more easily maneuvered to make the connection. The pins 522 can be used to guide the connection. In some example embodiments, the mating connector of the wagering game stand 108 is a floating connector. Accordingly, the sled assembly 106 can be at different angles (e.g., angled upward) during the connection process. The method 900 is complete.

Example Wagering Game Machine

FIG. 10 is a perspective view of a wagering game machine, according to some example embodiments. In particular, FIG. 10 illustrates an example of the wagering game machine 101 of FIG. 1. Referring to FIG. 10, a wagering game machine 101 is used in gaming establishments, such as casinos. According to embodiments, the wagering game machine 101 can be any type of wagering game machine and can have varying structures and methods of operation. For example, the wagering game machine 101 can be an electromechanical wagering game machine configured to play mechanical slots, or it can be an electronic wagering game machine configured to play video casino games, such as blackjack, slots, keno, poker, blackjack, roulette, etc.

The wagering game machine 101 comprises a housing 1012 and includes input devices, including value input devices 1018 and a player input device 1024. For output, the wagering game machine 101 includes a primary display 1014 for displaying information about a basic wagering game. The primary display 1014 can also display information about a bonus wagering game and a progressive wagering game. The wagering game machine 101 also includes a secondary display 1016 for displaying wagering game events, wagering game outcomes, and/or signage information. While some components of the wagering game machine 101 are described herein, numerous other elements can exist and can be used in any number or combination to create varying forms of the wagering game machine 101.

The value input devices 1018 can take any suitable form and can be located on the front of the housing 1012. The value input devices 1018 can receive currency and/or credits inserted by a player. The value input devices 1018 can include coin acceptors for receiving coin currency and bill acceptors for receiving paper currency. Furthermore, the value input devices 1018 can include ticket readers or barcode scanners for reading information stored on vouchers, cards, or other tangible portable storage devices. The vouchers or cards can authorize access to central accounts, which can transfer money to the wagering game machine 101.

The player input device 1024 comprises a plurality of push buttons on a button panel 1026 for operating the wagering game machine 101. In addition, or alternatively, the player input device 1024 can comprise a touch screen 1028 mounted over the primary display 1014 and/or secondary display 1016.

The various components of the wagering game machine 101 can be connected directly to, or contained within, the housing 1012. Alternatively, some of the wagering game machine's components can be located outside of the housing 1012, while being communicatively coupled with the wagering game machine 101 using any suitable wired or wireless communication technology.

The operation of the basic wagering game can be displayed to the player on the primary display 1014. The primary display 1014 can also display a bonus game associated with the basic wagering game. The primary display 1014 can include a cathode ray tube (CRT), a high resolution liquid crystal display (LCD), a plasma display, light emitting diodes (LEDs), or any other type of display suitable for use in the wagering game machine 101. In FIG. 10, the wagering game machine 101 is an "upright" version in which the primary display 1014 is oriented vertically relative to the player. Alternatively, the wagering game machine can be a "slant-top" version in which the primary display 1014 is slanted at about a thirty-degree angle toward the player of the wagering game machine 101. In yet another embodiment, the wagering game machine 101 can exhibit any suitable form factor, such as a free standing model, bartop model, mobile handheld model, or workstation console model.

A player begins playing a basic wagering game by making a wager via the value input device 1018. The player can initiate play by using the player input device's buttons or touch screen 1028. The basic game can include arranging a plurality of symbols along a payline 1032, which indicates one or more outcomes of the basic game. Such outcomes can be randomly selected in response to player input. At least one of the outcomes, which can include any variation or combination of symbols, can trigger a bonus game.

In some embodiments, the wagering game machine 101 can also include an information reader 1052, which can include a card reader, ticket reader, bar code scanner, RFID transceiver, or computer readable storage medium interface. In some embodiments, the information reader 1052 can be used to award complimentary services, restore game assets, track player habits, etc.

General

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

Each of the embodiments described herein are contemplated as falling within the inventive subject matter, which is set forth in the following claims.

What is claimed is:

1. An apparatus comprising:

a wagering game chair for a wagering game machine that is configured to present a wagering game, the wagering game chair including:

a seat having a seat bottom and a seat post, the seat post being part of a split-post configuration, the seat post having a top end and a bottom end, wherein the top end of the seat post is coupled to the seat bottom;

a first electrical connector positioned within and approximately at the bottom end of the seat post; and a first electrical cable electrically coupled to the first electrical connector, wherein the first electrical cable runs approximately a length of the seat post within the seat post, the first electrical cable configured to communicate audio of the wagering game from the wagering game machine to a speaker coupled to the wagering game chair;

a bracket positioned at the bottom end of the seat post, wherein the first electrical connector is affixed to the bracket; and a sled assembly for coupling the wagering game chair to the wagering game machine, the sled assembly including:

a sled having a first end and a second end, wherein the first end includes a game interface for coupling the sled to the wagering game machine;

a sled post that is part of the split-post configuration, the sled post having a bottom end and a top end, wherein the bottom end of the sled post is attached to the sled;

a second electrical connector positioned within and at approximately the top end of the sled post; and a second electrical cable electrically coupled to the second electrical connector, wherein the second electrical cable runs approximately a length of the sled post, wherein the sled post is configured for combining with the seat post of the split-post configuration such that the second electrical connector in the sled post is mated to the first electrical connector in the seat post, wherein the second electrical cable is configured to communicate the audio of the wagering game from the wagering game machine to the speaker coupled to the wagering game chair; and wherein at least one of the first electrical cable and the second electrical cable have a length to extend beyond the seat post and the sled post, respectively.

2. The apparatus of claim 1, wherein the seat post is configured for combining with a sled post of the split-post configuration, wherein the sled post is part of a sled assembly for coupling the wagering game chair to the wagering game machine.

3. The apparatus of claim 1, wherein the wagering game chair is rotatable about the seat post, wherein the first electrical cable comprises a flexible cable.

4. The apparatus of claim 1, wherein the sled comprises two or more wheels positioned at the first end.

5. The apparatus of claim 1, wherein the sled comprise a latching part at the first end for coupling the sled to the wagering game machine, wherein the latching part comprises two or more cams that are spring loaded such that the two or more cams retract out after the sled is engaged with the wagering game machine.

6. The apparatus of claim 5, wherein the latching part comprises a release handle, wherein the two or more cams retract in after the release handle is pulled outward.

7. An apparatus comprising:

a sled assembly for coupling a wagering game machine to a wagering game chair, wherein the wagering game machine is configured to present a wagering game, the sled assembly comprising, a sled having a first end and a second end, wherein the first end includes a game interface for coupling the sled to the wagering game machine;

a sled post that is part of a split-post configuration, the sled post having a bottom end and a top end, wherein the bottom end of the sled post is attached to the sled;

an electrical connector; and an electrical cable electrically coupled to the electrical connector, wherein the electrical cable runs approximately a length of the sled post, wherein the sled post is configured for combining with a seat post of the split-post configuration such that the electrical connector in the sled post is mated to a different electrical connector in the seat post, wherein the different electrical connector is attached to a bracket positioned at a bottom end of the seat post, wherein the wagering game machine is configured to transmit an electrical signal to the wagering game chair through the electrical cable, the electrical connector and the different electrical connector.

8. The apparatus of claim 7, wherein the electrical cable has a length to extend beyond the sled post.

9. The apparatus of claim 8, wherein the electrical connector is not affixed to the sled post.

10. The apparatus of claim 7, wherein the electrical signal comprises audio associated with presentation of the wagering game.

11. The apparatus of claim 7, wherein the sled comprises a latching part at the first end for coupling the sled to the wagering game machine, wherein the latching part comprises two or more cams that are spring loaded such that the two or more cams retract out after the sled is engaged with the wagering game machine.

12. The apparatus of claim 11, wherein the latching part comprises a release handle, wherein the two or more cams retract in after the release handle is pulled outward.

13. A method comprising:

positioning a wagering game chair to access a first electrical connector that is located approximately at a bottom end of a seat post that extends from a seat bottom of the wagering game chair, wherein the bottom end is at an opposite end of a top end of the seat post that is coupled to the seat bottom, the first electrical connector electrically coupled to an audio component within the wagering game chair through a first electrical cable that runs through the seat post, and wherein the first electrical connector is within a bracket affixed to the seat post to hold the first electrical connector at approximately the bottom end of the seat post;

positioning a sled assembly to access a second electrical connector that is electrically coupled to a second electrical cable that runs through a sled post that extends up from a base of the sled assembly, wherein a length of the second electrical cable is such that the second electrical cable is extendible beyond a top end of the sled post, the second electrical connector not affixed to the sled post, wherein the sled assembly is configured for electrically coupling to a wagering game machine that is configured to present a wagering game, wherein audio is communicated from the wagering game machine to the audio component during presentation of the wagering game;

connecting the first electrical connector to the second electrical connector; and mating the seat post with the sled post to form a split post, wherein the first electrical connector and the second electrical connector are housed within the split post.

14. The method of claim 13, wherein the method further comprises:

extending the second electrical cable beyond the top end of the sled post prior to connecting the first electrical connector to the second electrical connector; and placing the second electrical cable that is extended beyond the top end of the sled post back into the sled post.

15. The method of claim 13, wherein mating the seat post with the sled post comprises sliding the seat post over the sled post to form the split post.

16. The method of claim 13, further comprising placing a component through a first hole and a second hole within the split post to set a height of the wagering game chair.

17. The method of claim 13, further comprising electrically connecting a wagering game interface of the sled assembly to a connector of a wagering game stand, wherein the wagering game machine is electrically coupled to and positioned on top of the wagering game stand.

* * * * *